US010934122B2

(12) United States Patent
Murphy

(10) Patent No.: US 10,934,122 B2
(45) Date of Patent: Mar. 2, 2021

(54) BRAKE ASSEMBLY FOR A TAPE DISPENSER

(71) Applicant: KITARU INNOVATIONS INC., St. Michael (BB)

(72) Inventor: John Gordon Murphy, St. James (BB)

(73) Assignee: Kitaru Innovations Inc., St. Michael (BB)

( * ) Notice: Subject to any disclaimer, the term of this patent is extended or adjusted under 35 U.S.C. 154(b) by 0 days.

(21) Appl. No.: 16/677,796

(22) Filed: Nov. 8, 2019

(65) Prior Publication Data

US 2020/0071115 A1 Mar. 5, 2020

Related U.S. Application Data

(62) Division of application No. 15/340,381, filed on Nov. 1, 2016, now Pat. No. 10,501,277.

(51) Int. Cl.
*B65H 35/00* (2006.01)
*B65H 23/08* (2006.01)

(52) U.S. Cl.
CPC ..... *B65H 35/0026* (2013.01); *B65H 23/08* (2013.01); *B65H 2301/44921* (2013.01); *B65H 2402/41* (2013.01); *B65H 2404/732* (2013.01)

(58) Field of Classification Search
CPC ..... B65H 35/0026; B65H 23/08; B65H 2301/44921; B65H 2402/41; B65H 2404/732
See application file for complete search history.

(56) References Cited

U.S. PATENT DOCUMENTS

| | | | | |
|---|---|---|---|---|
| 4,244,503 | A | 1/1981 | Kramer | |
| 4,405,068 | A | 9/1983 | Blair | |
| 4,729,518 | A * | 3/1988 | Mathna | B65H 35/0026 156/527 |
| 5,171,397 | A | 12/1992 | Arnold | |
| 5,562,262 | A | 10/1996 | Pennell | |
| 5,612,474 | A | 3/1997 | Patel | |
| 5,820,005 | A | 10/1998 | Perkitney et al. | |
| 5,913,178 | A | 6/1999 | Olsson | |
| 6,467,717 | B1 * | 10/2002 | Pedicano | A47K 10/3836 242/422.5 |
| 7,175,062 | B2 | 2/2007 | Shah | |
| 10,017,349 | B2 | 7/2018 | Chandaria et al. | |
| 10,494,217 | B2 | 12/2019 | Murphy | |
| 10,544,003 | B2 | 1/2020 | Murphy | |
| 2002/0190091 | A1 | 12/2002 | Shah | |
| 2004/0124305 | A1 | 7/2004 | Huang | |
| 2005/0145343 | A1 * | 7/2005 | Somers | B65H 35/0033 156/577 |
| 2006/0076384 | A1 | 4/2006 | Dickie | |
| 2006/0213622 | A1 | 9/2006 | Yu Chen | |
| 2006/0260759 | A1 | 11/2006 | Huang | |
| 2008/0067211 | A1 | 3/2008 | Steele et al. | |
| 2008/0116313 | A1 | 3/2008 | Chandaria | |
| 2011/0005688 | A1 | 1/2011 | Chang | |
| 2013/0341373 | A1 | 12/2013 | Chandaria et al. | |

(Continued)

*Primary Examiner* — Omar Flores Sanchez

(57) ABSTRACT

A tape dispenser housing wound adhesive tape includes a brake spoke tapering (i.e., narrowing) from a distal radial end to a proximal radial end relative to a tape rotational axis, wherein the brake spoke effectuates the braking of wound adhesive tape on a hub by contacting the wound adhesive tape, the hub, or both simultaneously.

13 Claims, 13 Drawing Sheets

(56) References Cited

U.S. PATENT DOCUMENTS

| | | | |
|---|---|---|---|
| 2018/0118493 | A1 | 5/2018 | Murphy |
| 2018/0118496 | A1 | 5/2018 | Murphy |
| 2018/0118497 | A1 | 5/2018 | Murphy |
| 2018/0118498 | A1 | 5/2018 | Murphy |

* cited by examiner

BRAKE ASSEMBLY FOR A TAPE DISPENSER

CROSS REFERENCE TO RELATED APPLICATIONS

This application is a divisional application of U.S. patent application Ser. No. 15/340,381 filed Nov. 1, 2016, the entire disclosure of which is incorporated herein by reference.

BACKGROUND

Technical Field

The present disclosure relates generally to tape dispensers. More particularly, the present disclosure relates to a braking or brake assembly for a tape dispenser. Specifically, the present disclosure relates to brake spokes having a unique configuration for applying a braking force.

Background Information

Adhesive tape is typically provided on a hub and is configured to be unwound therefrom to dispense the tape. Additionally, the adhesive tape is typically housed in a hand-held tape dispenser.

Issues continue to exist with hand-held tape dispensers. Particularly, as the tape is dispensed, it may over-rotate. The over-rotation of tape unwinding from the hub may cause tape to be wasted for the given taping task. Or, the over rotation may cause the tape to become knotted.

Some prior art has attempted to cure the over-rotation of tape during dispensing by providing ways to frictionally engage the unwinding tape to effectuate a braking force. For example, U.S. Pat. No. 6,612,474 (the '474 patent) discloses a tape dispenser brake mechanism utilizing an inwardly extending brake spoke configured to contact the annular hub of a roll of tape. The '474 patent further discloses that the brake spoke extends into an annular void defined between an outer surface and an inner surface on the hub. Nothing in the '474 patent suggests that the brake spoke or one of the arcuate ribs contact the tape sidewall defined by the roll of tape.

Additionally, U.S. Pat. No. 7,175,062 (the '062 patent) is prior art and utilizes a depressible and flexible sidewall to act as a brake to slow a roll of wound tape on a hub rotating about an axle. The '062 patent indicates that the inside surface of the sidewall contacts both the hub and the wound roll of tape. Notably, the '062 patent does not utilize brake spokes, however it does use guide spokes (but they do not provide any braking effect). The guide spokes of the '062 patent are used to fit within the annular void positioned between the outer portion and the inner portion of the hub. Thus, they guide the tape hub and are not configured to stop the hub with a braking force.

SUMMARY

Issues continue to exist with dispensing tape and the prior art braking means. As such, the present disclosure provides a solution that improves the braking effect to effectively stop the unwinding of tape from the dispenser.

In one aspect, an embodiment of the present disclosure may provide a tape dispenser comprising a brake spoke tapering (i.e., narrowing) from a distal radial end to a proximal radial end relative to a tape rotational axis, wherein the brake spoke effectuates the braking of wound adhesive tape on a hub by contacting the adhesive tape and hub simultaneously.

In another aspect, an embodiment of the present disclosure may provide a tape dispenser comprising: a first side member and an opposing second side member; an axle extending between the first and second side members defining a hub axis; a hub carrying wound adhesive tape therearound configured to be unwound and dispensed, and the hub positioned concentric around the axle to rotate about the hub axis; a first brake spoke extending from a first inner surface on the first side member; and a tapered wall on the first brake spoke, wherein when the first side member is flexed, the tapered wall effectuates braking of the adhesive tape and the hub.

In another aspect, an embodiment of the present disclosure may provide a method dispensing wound tape and braking the same comprising the steps of: dispensing adhesive tape wound around a hub from a tape dispenser having brake spokes extending inwardly in a cantilevered manner from opposing side members; flexing the opposing side members inwardly towards each other; and contacting a tapered end wall on each brake spoke with the wound adhesive tape, the hub, or both simultaneously to effectuate braking of the adhesive tape wound around the hub.

In another aspect, an embodiment of present disclosure may provide a tape dispensing system comprising: a new wound roll of adhesive tape carried by a hub, the wound roll of adhesive tape defining an annular sidewall concentric with a hub axis; and a brake spoke carried by a side member on a tape dispenser, wherein the roll of adhesive tape is disposed within the tape dispenser, and the brake spoke is aligned to extend entirely along the annular sidewall and adapted to contact the annular sidewall to impart a braking force after tape is unwound from the roll.

In another aspect, an embodiment of the present disclosure may provide a method comprising: providing a new wound roll of adhesive tape carried by a tape dispenser including a brake spoke extending cantilevered form a side member, wherein the brake spoke is at least as long as an annular sidewall of the wound roll of adhesive tape prior to dispensing the roll from the tape dispenser; pulling a portion of the adhesive tape to unwind a portion of tape; and engaging the brake spoke with the annular sidewall to impart a braking force to slow the adhesive tape from unwinding.

In another aspect, an embodiment of the present disclosure may provide a tape dispenser comprising: a first side member and an opposing second side member; an axle extending between the first and second side members defining a hub axis; a hub carrying wound adhesive tape therearound configured to be unwound and dispensed, and the hub positioned concentric around the axle to rotate about the hub axis; a first brake spoke extending from a first inner surface on the first side member and a free end wall on the first brake spoke, wherein when the first side member is flexed, and the end wall effectuates braking of the adhesive tape and the hub by contacting one of the following (i) the adhesive tape, (ii) the hub, and (iii) the adhesive tape and the hub simultaneously; and an imaginary radial line extending radially from the hub axis, wherein the imaginary radial line intersects the first brake spoke at two points. In this embodiment, the brake spoke may have an arcuate profile. Or, the imaginary radial line may intersect the brake spoke at first and second ends. Or, the imaginary radial line may not intersect an intermediate portion of the brake spoke. This embodiment may also include a plurality of brake spokes, wherein the first brake spoke is one brake spoke forming the plurality of brake spokes, wherein the imaginary radial line only intersects the first brake spoke. There may be a second brake spoke adjacent the first brake spoke, wherein the imaginary radial line intersects the second brake spoke at least once. In fact, the imaginary radial line may intersect the second brake spoke twice.

In another aspect, an embodiment of the present disclosure may provide a tape dispenser comprising: a first side member and an opposing second side member; an axle extending between the first and second side members defining a hub axis; a hub carrying wound adhesive tape therearound configured to be unwound and dispensed, and the hub positioned concentric around the axle to rotate about the hub axis; a first brake spoke extending from a first inner surface on the first side member and a free end wall on the first brake spoke, wherein when the first side member is flexed, and the end wall effectuates braking of the adhesive tape and the hub by contacting one of the following (i) the adhesive tape, (ii) the hub, and (iii) the adhesive tape and the hub simultaneously; and an imaginary radial line extending radially from the hub axis, wherein the imaginary radial line intersects the first brake spoke at only one point.

BRIEF DESCRIPTION OF THE SEVERAL VIEWS OF THE DRAWINGS

A sample embodiment of the disclosure is set forth in the following description, is shown in the drawings and is particularly and distinctly pointed out and set forth in the appended claims. The accompanying drawings, which are fully incorporated herein and constitute a part of the specification, illustrate various examples, methods, and other example embodiments of various aspects of the disclosure. It will be appreciated that the illustrated element boundaries (e.g., boxes, groups of boxes, or other shapes) in the figures represent one example of the boundaries. One of ordinary skill in the art will appreciate that in some examples one element may be designed as multiple elements or that multiple elements may be designed as one element. In some examples, an element shown as an internal component of another element may be implemented as an external component and vice versa. Furthermore, elements may not be drawn to scale.

Similar numbers refer to similar parts throughout the drawings.

DETAILED DESCRIPTION

Figure 1:
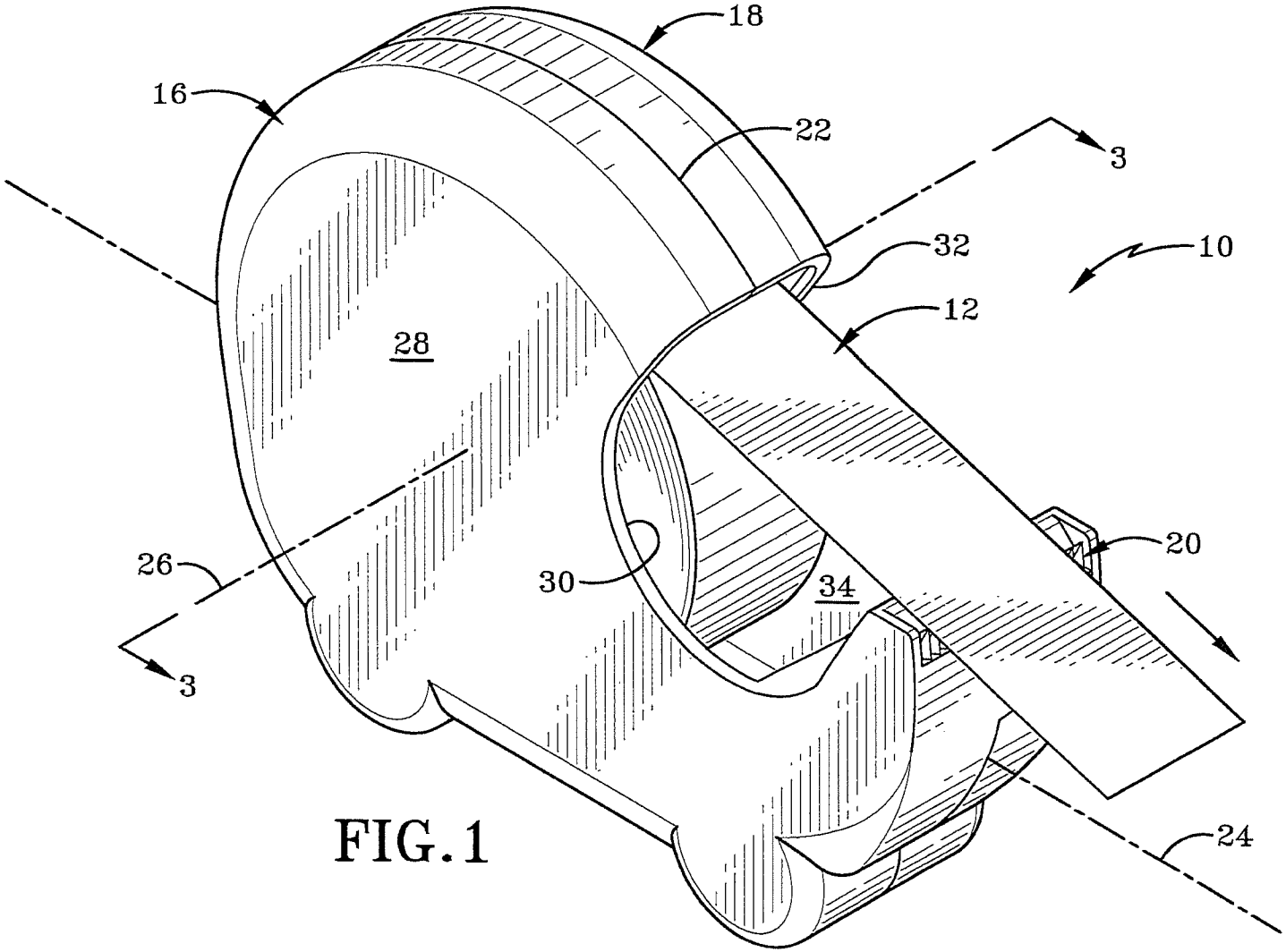
FIG. 1 is a perspective view of a tape dispenser having a braking means in accordance with the present disclosure.
Figure 2A:
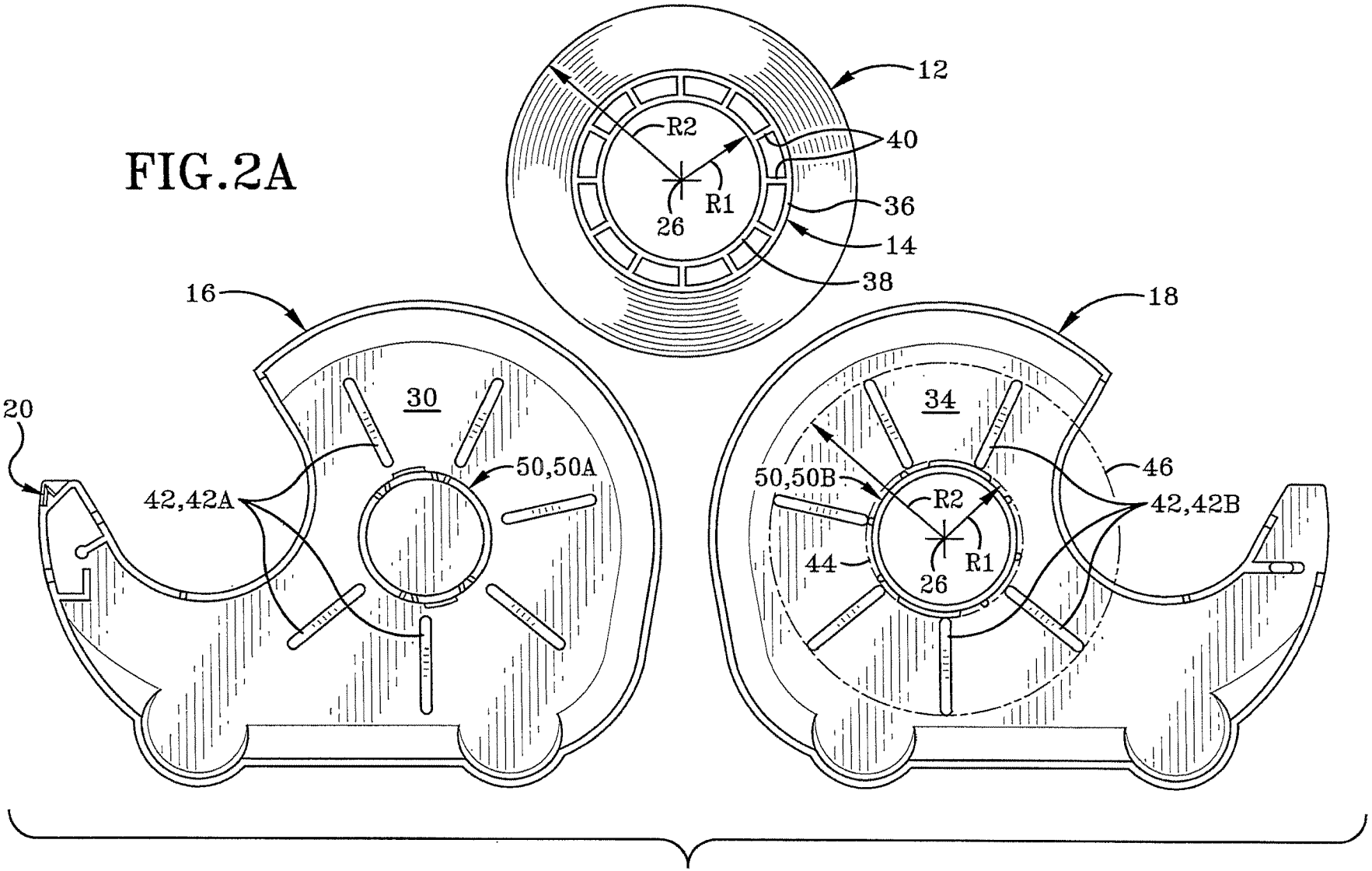
FIG. 2A is a side elevation view of the disassembled tape dispenser, having one type of brake spokes.

As depicted in FIG. 1, a tape dispenser in accordance with the present disclosure is generally indicated at 10. The tape dispenser 10 is configured to house a roll of adhesive tape 12 therein and for dispensing therefrom. The roll of the adhesive tape 12 is mounted on a hub 14 (FIG. 2A). Hub 14 may also be referred to as a "core" or "tape core" in the adhesive tape industry. The tape dispenser 10 further comprises a first side member 16, a second side member 18, and a cutter member 20.

The first and second side members 16, 18 are aligned side-by-side and meet at a parting line or union 22 defining the longitudinally aligned center plane 24. Longitudinal center plane 24 may also be referred to as a longitudinal axis.

When assembled, hub 14 is concentric about a hub axis 26 which is orthogonal to longitudinal center plane 24. The hub axis 26 may also be referred to as a transverse axis 26. As will be described in greater detail below, the roll of adhesive tape 12 is configured to dispense tape from dispenser 10 as hub 14 rotates about hub axis 26.

The first side member includes a first surface 28 opposite a second surface 30 (FIG. 2A). When tape dispenser 10 is assembled, first surface 28 faces outwardly and second surface 30 faces inwardly towards second side member 18. Similarly, second side member 18 includes a first outside facing surface 32 opposite an inwardly facing second surface 34 (FIG. 2A).

With continued reference to FIG. 1, the cutter member 20 is mounted between the first surface 28 on first side member 16 and the first surface 32 on second side member 18. The cutter member 20 spans the parting line 22 and connects to each the first side member 16 and the second side member 18.

As depicted in FIG. 2A through FIG. 2D, the hub 14 may comprise an outer cylindrical wall 36 and an inner cylindrical wall 38 connected together by inner member 40 such that the hub 14 is I-shaped in longitudinal cross-section.

Each side member has a plurality of brake spokes 42 extending inwardly in a cantilevered manner from a rigid connection with a respective inner surface. More particularly, a first set of brake spokes 42A are connected to inner surface 30 on first side member 16. A second set of brake spokes 42B connect to the inner surface 34 of second side member 18.

The brake spokes 42 can be configured in a number of different ways to impart a braking force to the hub 14, or impart a braking force to the adhesive tape wound around hub 14, or a combination of simultaneously imparting a braking force to the hub 14 and to the adhesive tape 12. The brake spokes 42 may have a length oriented radially relative to hub axis 26 that spans from inner cylindrical wall 38 on hub 14 to the radial outermost portion of adhesive tape 12 in an assembled position.

With continued reference to FIG. 2A, the imaginary dashed circle 44 corresponds to the profile of inner cylindrical wall 38 having a radius R1. The radial outermost surface of adhesive tape 12 is represented by a dashed circle 46 having a radius R2. The length of the brake spokes 42A, 42B is equal to radius R2 less radius R1. In this regard, when a braking force is applied by pressing and flexing the first and second side members 16, 18 through manual squeezing force along the hub axis 26, the brake spokes 42A, 42B contact the adhesive tape 12 and the hub 14 simultaneously. Collectively, this imparts a braking force to stop the adhesive tape 12 from being over dispensed.

The brake spokes of FIG. 2A are shown as linear members spaced generally regular about hub axis 26. In one particular embodiment, there may be five brake spokes located on each respective side member. However, the number of brake spokes is not intended to be limiting and there may be more than five brake spokes on each side member or less than five brake spokes on each side member. It is recognized that the optimal number of brake spokes located on each side member may be determined through iterative testing as one have ordinary skill in the art would understand.

Figure 2B:
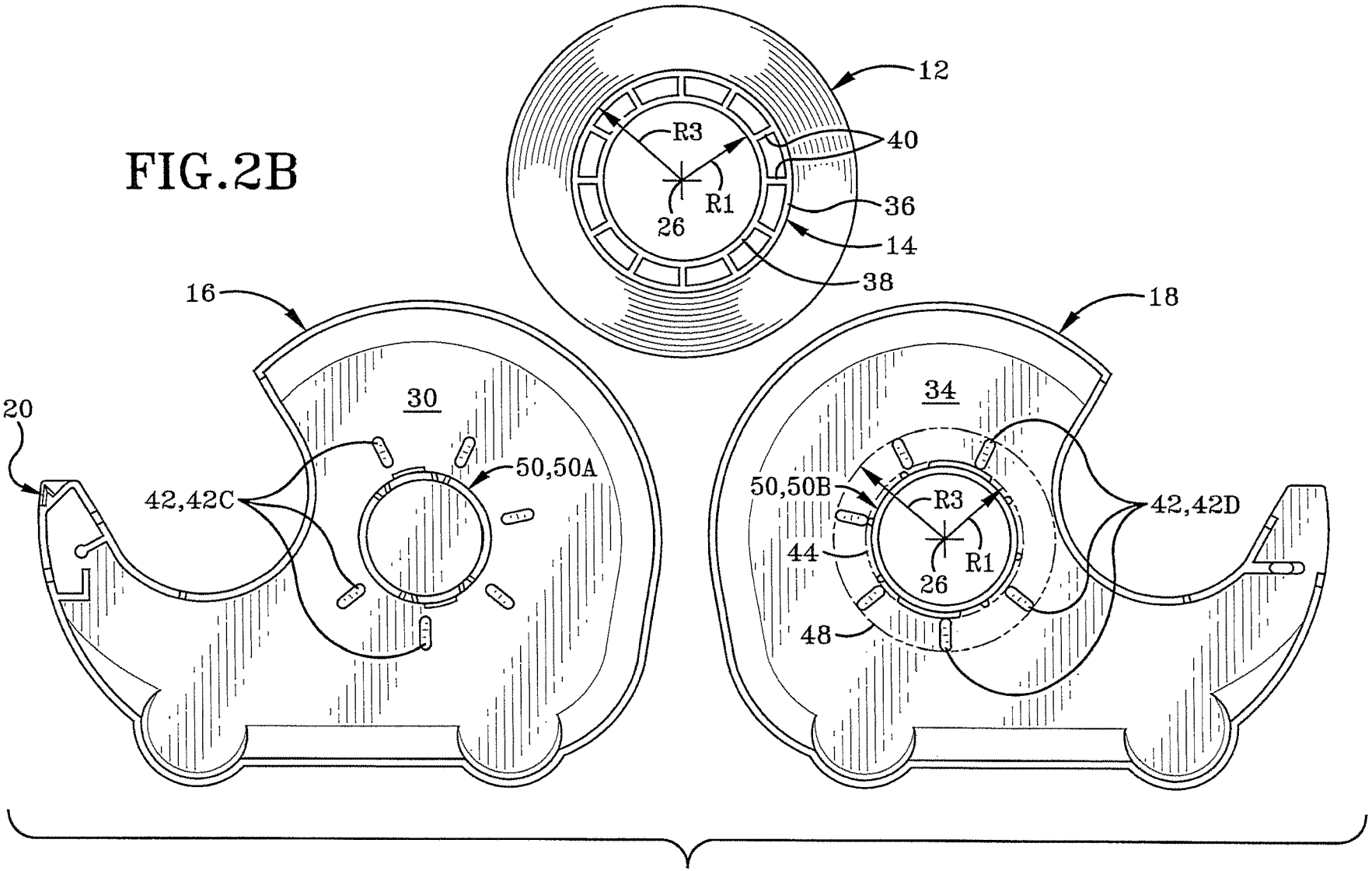
FIG. 2B is a side elevation view of the disassembled tape dispenser, having another type of brake spokes.

As depicted in FIG. 2B, a first set of brake spokes 42C may extend in a cantilevered manner from the inner surface 30 of first side member 16. A second set of brake spokes 42D may opposingly extend in a cantilevered manner from the inner surface 34 on second side member 18. In the embodiment of FIG. 2B, the plurality of brake spokes 42C, 42D may extend radially a linear length relative to hub axis 26 that corresponds to the distance from the profile 44 corresponding to inner cylindrical wall 38 to the imaginary profile 48 having a radius R3 which corresponds to the outer cylindrical wall 36 on hub 14. The radial length of brake spokes 42C, 42D is equal to radius R3 less radius R1. The radial length of brake spokes 42C, 42D corresponds in a manner such that the brake spokes engage the hub 14 when the first side member 16 and the second side member 18 are flexed inwardly towards each other along hub axis 26 to impart a braking force to the adhesive tape 12.

With continued reference to FIG. 2B, the first set of brake spokes 42C and the second set of brake spokes 42D are oriented orthogonal relative to transverse hub axis 26. The orthogonal alignment establishes brake spokes 42C, 42D as linear members spaced circumferentially about the transverse axis 26.

Figure 2C:
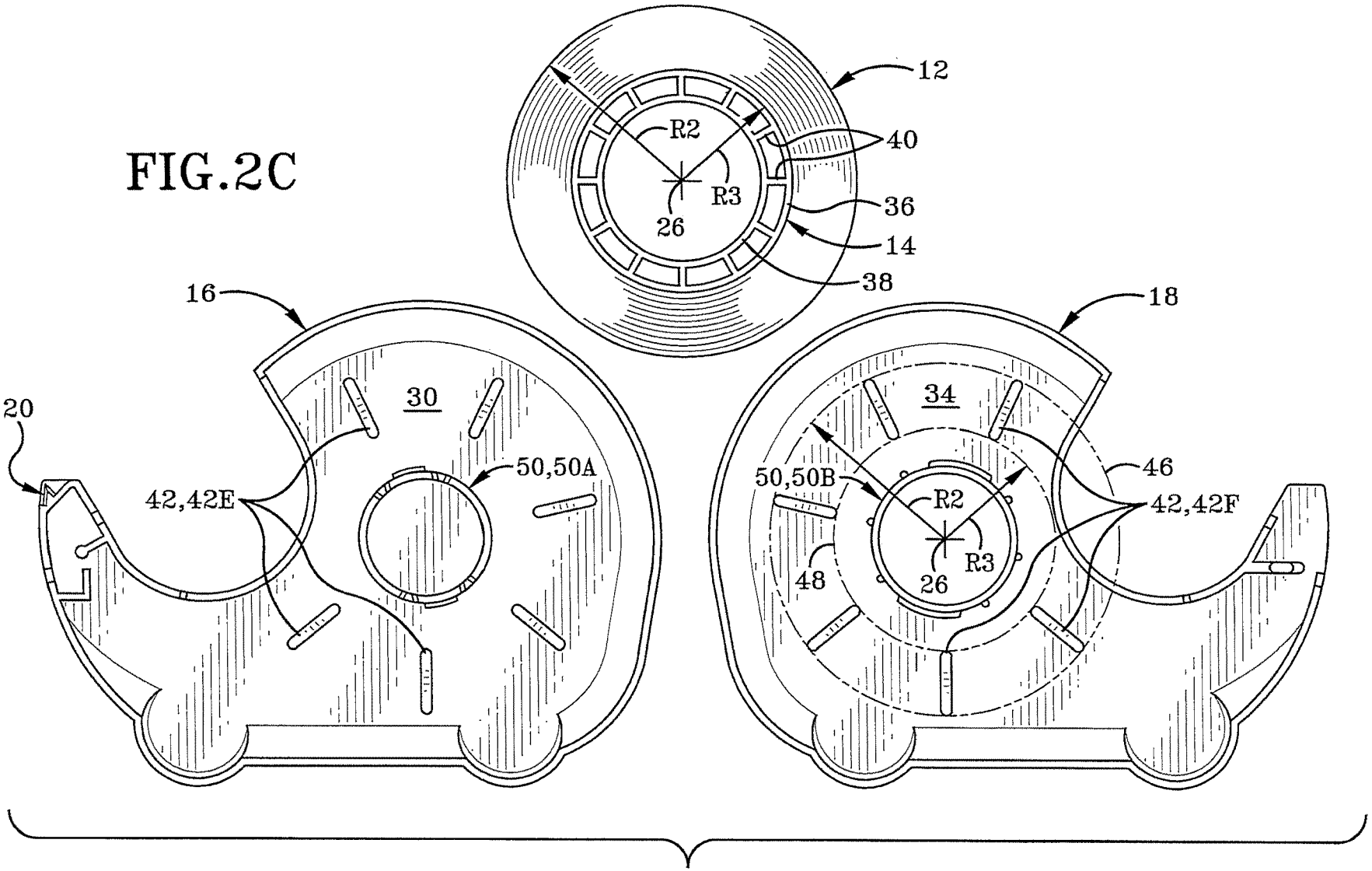
FIG. 2C is a side elevation view of the disassembled tape dispenser, having another type of brake spokes.

As depicted in FIG. 2C, a first set of brake spokes 42E are positioned cantilevered on the inner second surface 30 of first side member 16 and a set of brake spokes 42F are positioned opposingly cantilevered on the inner surface 34 of second side member 18. The brake spokes 42E, 42F identified in FIG. 2C are positioned orthogonally relative to hub axis 26 such that they are radially linear and have a length that corresponds to contact the adhesive tape 12 wound on hub 14. The brake spokes 42E, 42F have a length equal to the radius R2 less radius R3, which corresponds to the outer profile 46 of adhesive tape 12 and profile 48 of outer cylindrical wall 36 respectively. Notably, the brake spokes 42E, 42F identified in FIG. 2C contact the adhesive tape 12 to impart a braking force, but would not contact hub 14. Stated otherwise, brake spokes 42E, 42F are purposely spaced from a cylindrical axle 50 which will be described in greater detail below. The brake spokes 42E, 42F spaced from cylindrical axle 50 define a space that is equal to the radial length of hub 14 from outer cylindrical wall 36 to inner cylindrical wall 38. This may provide an advantage of a brake spoke that contacts adhesive tape 12 which is distinct from U.S. Pat. No. 7,175,062 which only contacts its adhesive tape by utilizing the inner surface of the side member.

Figure 2D:
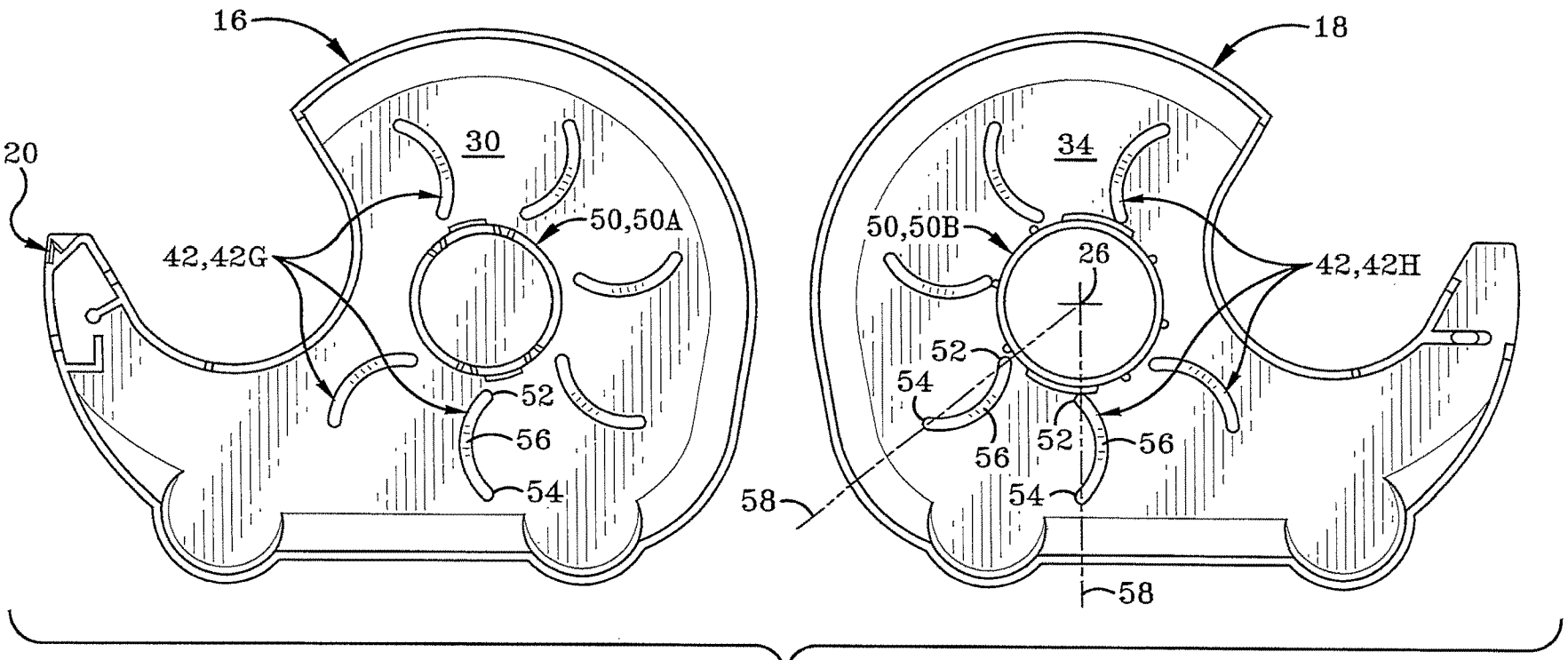
FIG. 2D is a side elevation view of the disassembled tape dispenser, having another type of brake spokes.

As depicted in FIG. 2D, a plurality of brake spokes 42G extend in a cantilevered manner from the inner surface 30 on first side member 16 and a second set of brake spokes 42H extend in a cantilevered manner from the inner surface 34 on second side member 18. Brake spokes 42G, 42H are non-linear when viewed from the side. More particularly, brake spokes 42G, 42H extend radially (relative to axis 26) in an arcuate manner. Furthermore, each brake spoke 42G, 42H may include a first end 52, a second end 54, and an intermediate portion 56. Brake spokes 42G, 42H are positioned such that the first end 52 and the second end 54 intersect an imaginary radial line 58 orthogonal to hub axis 26. Intermediate portion 56 does not intersect imaginary line 58. The brake spoke 42G, 42H extends in an arcuate manner between first end 52 to second end 54 such that the intermediate portion 56 is offset from imaginary radial line 58.

The length associated with brake spokes 42G, 42H relative to hub axis 26 would correspond to brake spokes that would contact the adhesive tape 12 and the hub 14 simultaneously. Stated otherwise, the radial length along imaginary radial line 58 associated with brake spokes 42G, 42H would correspond to that generally equal to radius R2 less radius R1.

Figure 2E:
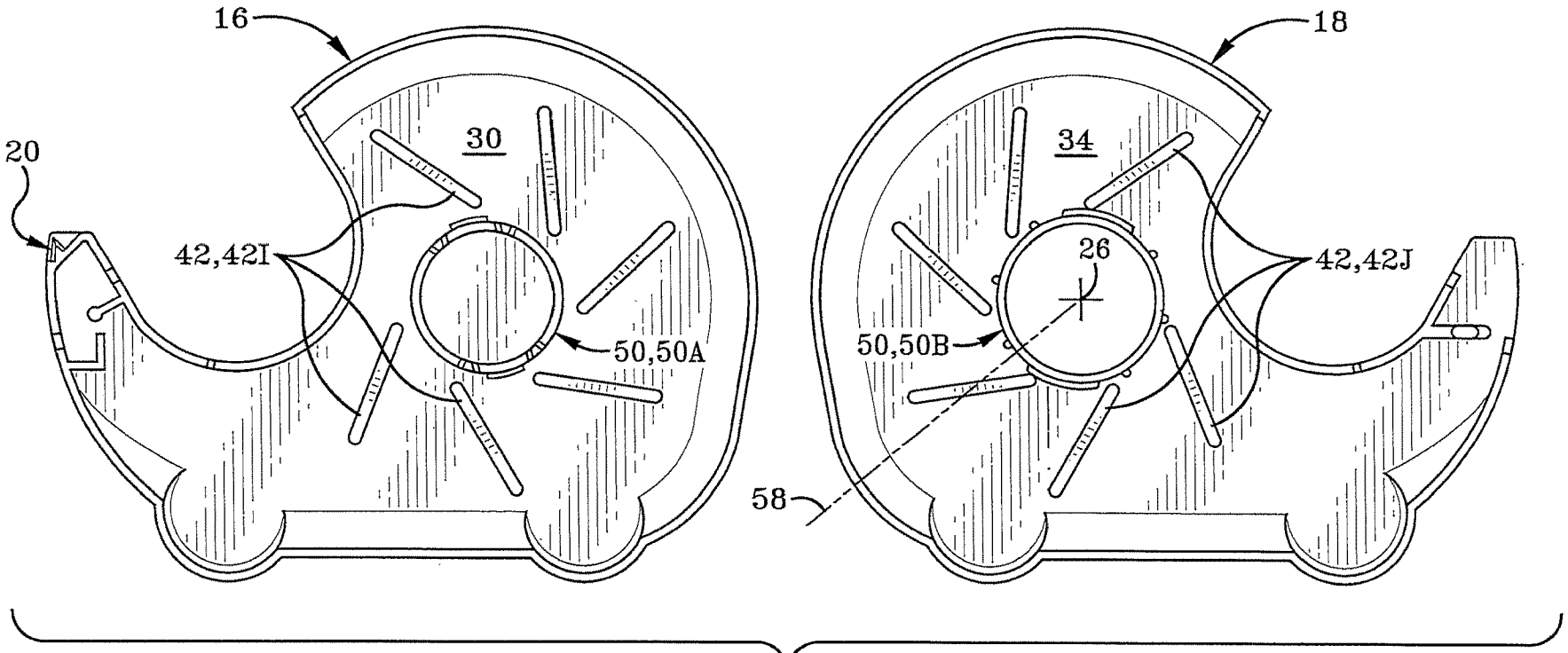
FIG. 2E is a side elevation view of the disassembled tape dispenser, having another type of brake spokes.

FIG. 2E depicts brake spokes 42I, 42J that are cantileveredly attached to inner surfaces of first side member 16 and second side member 18, respectively. Brake spokes 42I, 42J are linear, but not orthogonal relative to transverse of axis 26 along their entire length. State otherwise, an imaginary line 58 only intersects a single point of the respective individual brake spoke. The first set of brake spokes 42I and the second set of brake spokes 42J have a radial length that would correspond to contact the hub 14 and the entire roll of adhesive tape 12. This would impart a braking effect when the first and second side members are respectively squeezed along the transverse hub axis causing brake spokes 42I, 42J to contact the hub 14 and the adhesive tape 12 simultaneously.

Figure 2F:
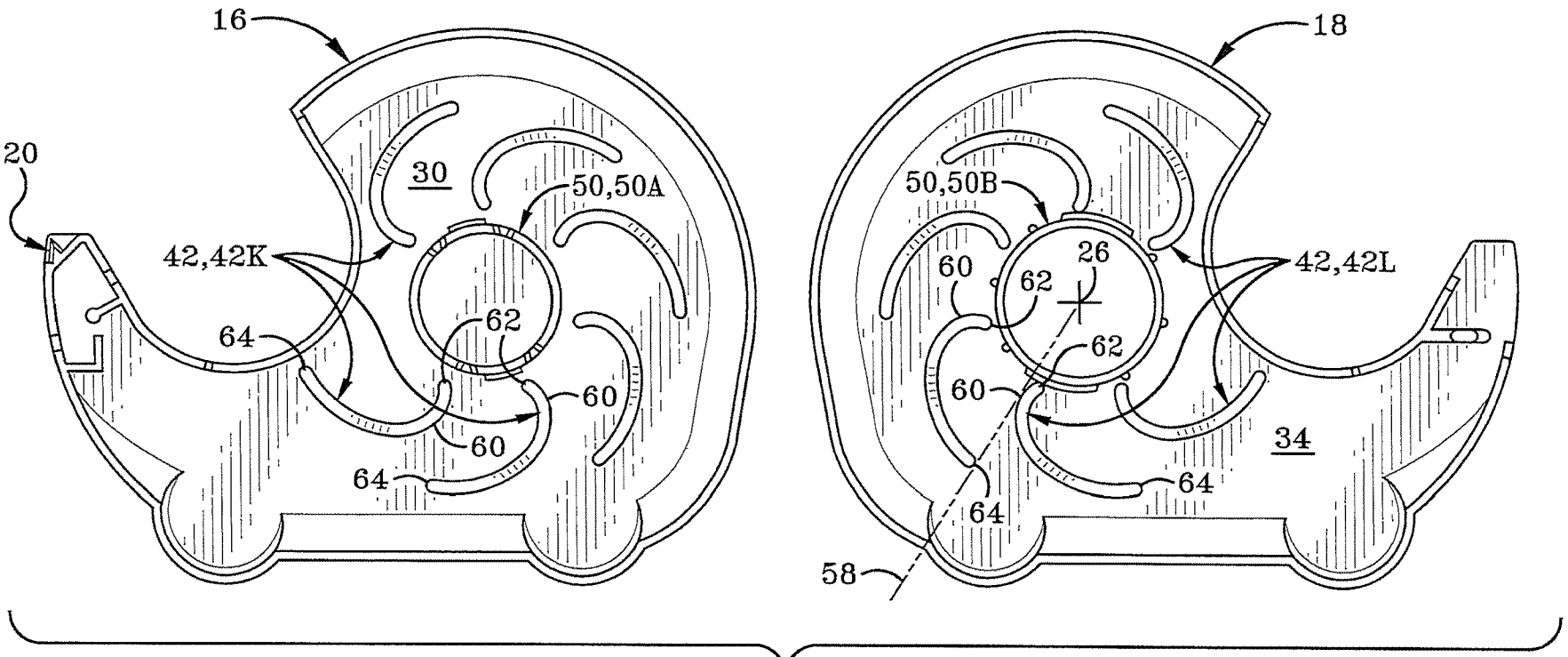
FIG. 2F is a side elevation view of the disassembled tape dispenser, having another type of brake spokes.

FIG. 2F depicts arcuately extending cantilevered brake spokes 42K and brake spokes 42L. Brake spokes 42K, 42L extend arcuately in a manner similar to that of brakes spokes 42G, 42H. However, arcuate brake spokes 42K, 42L have a greater curve length that is asymmetric with respect to the curved apex. In this particular embodiment, the apex is defined as the intermediate portion 60 which is intermediate the first end 62 and the second end or tail end 64 which is farther away from hub axis 26. The asymmetrical apex 60 faces the direction of unwinding rotation of adhesive tape 12. Brake spokes 42K, 42L may be considered asymmetrically parabolic in shape. With continued reference to FIG. 2F, an imaginary radial line 58 intersects apex 60 on one of the brake spokes and intersects the second end 64 on an adjacent brake spoke. Stated otherwise, the imaginary radial line 58 drawn relative to hub axis 26 intersects two adjoining brake spokes.

Figure 3:
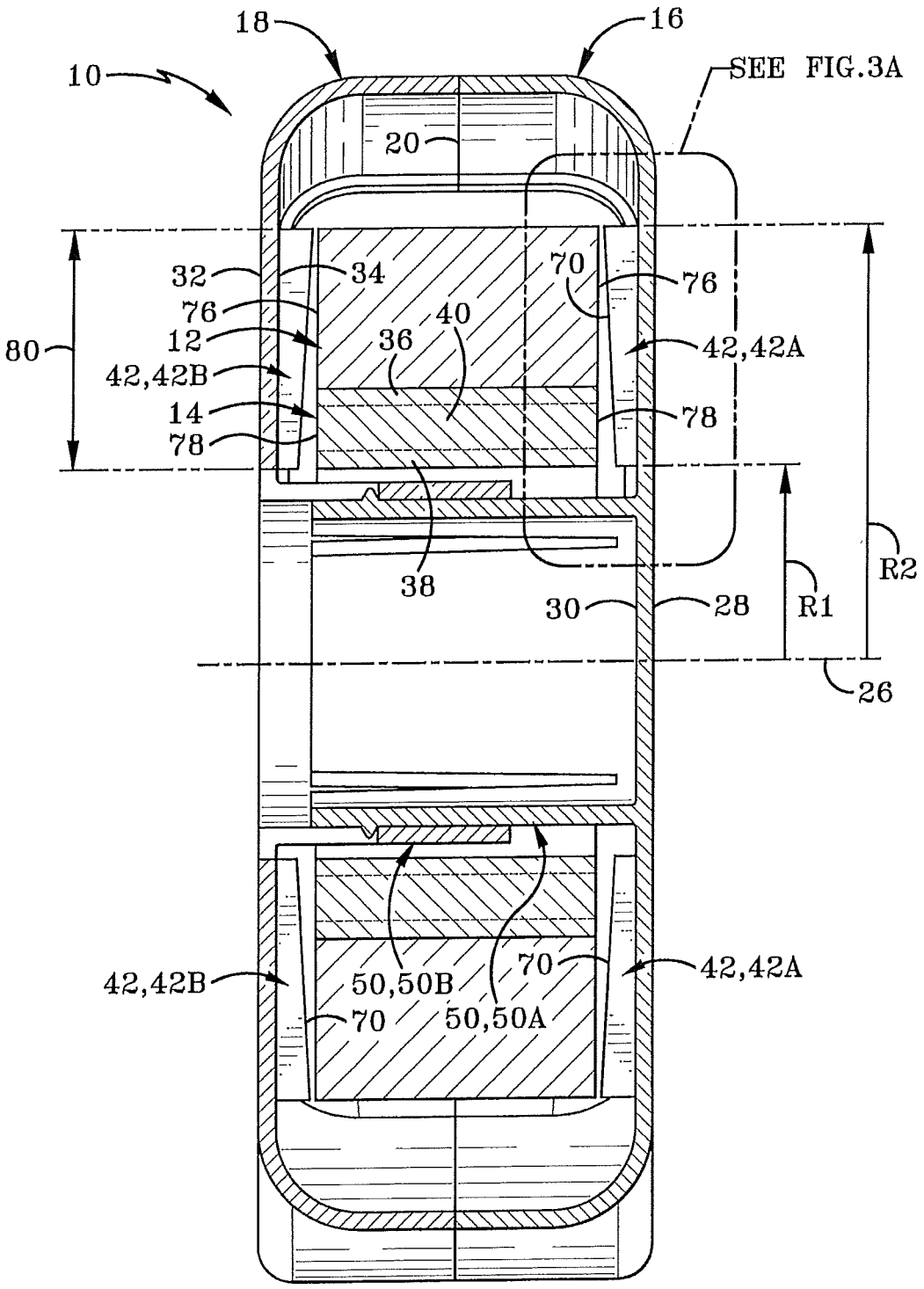
FIG. 3 is a transverse cross section view taken along line 3-3 in FIG. 1 of the assembled tape dispenser having the type of brake spokes presented in FIG. 2A.

FIG. 3 depicts a transverse cross-section taken along line 3-3 in FIG. 1. The transverse cross-section of assembled tape dispenser 10 depicts the coaxial nesting fit of cylindrical axle 50, which is defined by first axle 50A attached to the first side member 16 and an axle second portion 50B attached to second side member 18. The assembled axle 50 enables hub 14 to rotate therearound while carrying adhesive tape 12. Cylindrical axle 50 is centered concentrically with hub axis 26.

Figure 3A:
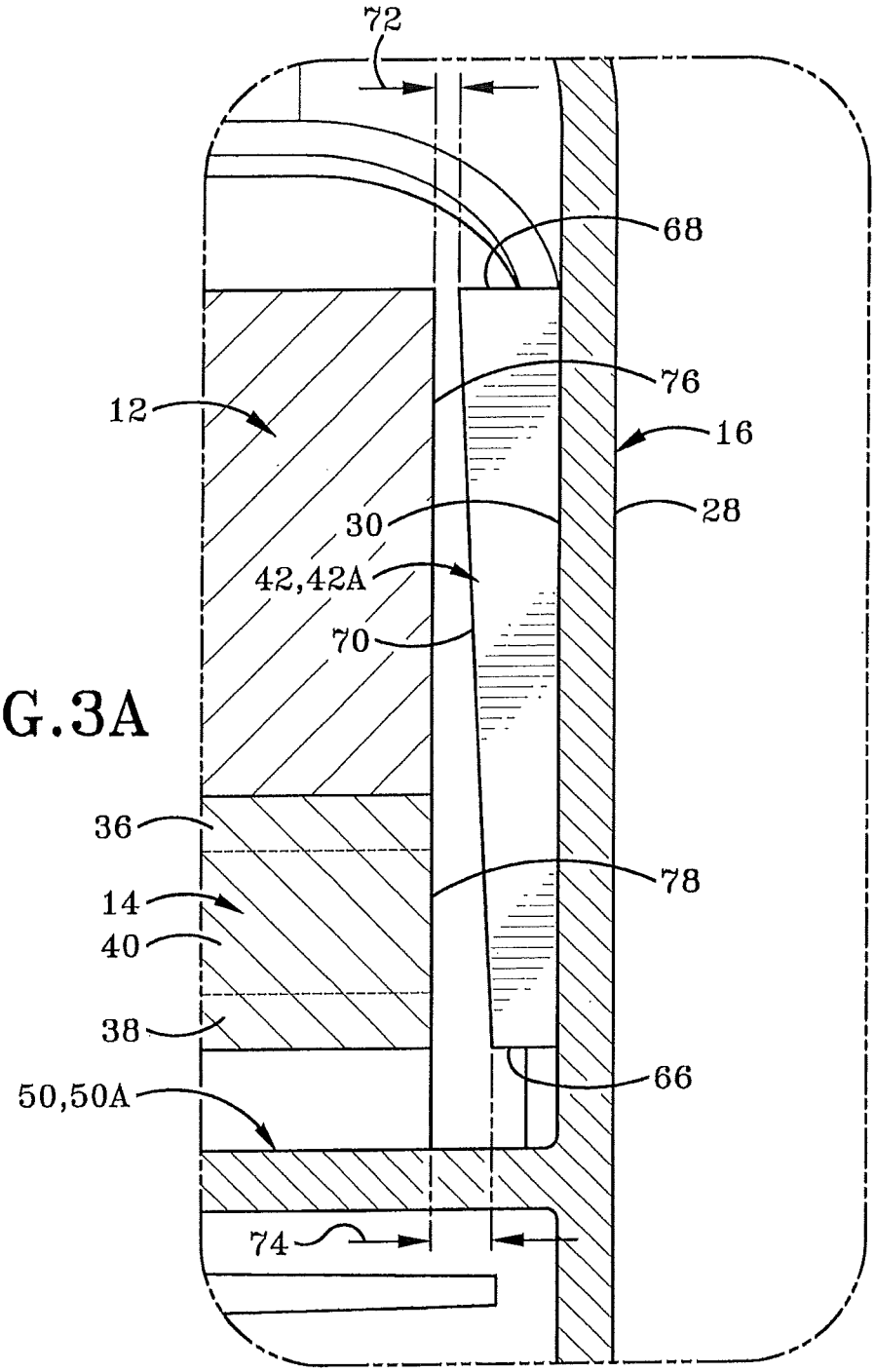
FIG. 3A is an enlarged cross section view of the region labeled "SEE FIG. 3A" in FIG. 3.

FIG. 3A depicts an enlarged cross-section view of brake spoke 42B located on the inside surface 34 of second side member 18. Brake spoke 42B is the same brake spoke embodied in FIG. 2A. Brake spoke 42B includes a proximal radial end 66 and a distal radial end 68 relative to hub axis 26. The proximal end 66 is closer to hub axis 26 than the distal end 68. The distal end wall defining distal end 68 is cantilevered longer than the proximal end wall defining proximal end 66. As such, an inwardly facing terminal wall 70 tapers radially from the distal end 68 towards the proximal end 66. Terminal end wall 70 is a free end that does not contact the tape 12 or the hub 14 when the second side member 18 is in a first neutral position as depicted in FIG. 3A. Accordingly, a gap is defined between the terminal end wall 70 and the adhesive tape 12 carried by hub 14. Because the distal end wall cantilevered length is greater than the proximal end wall defining proximal end 66, a distal portion of the gap is narrower than proximal portion of the gap. The distal portion of the gap is represented by smaller dimension lines 72 and the proximal portion of the gap is represented by the greater dimension lines 74.

Figure 4:
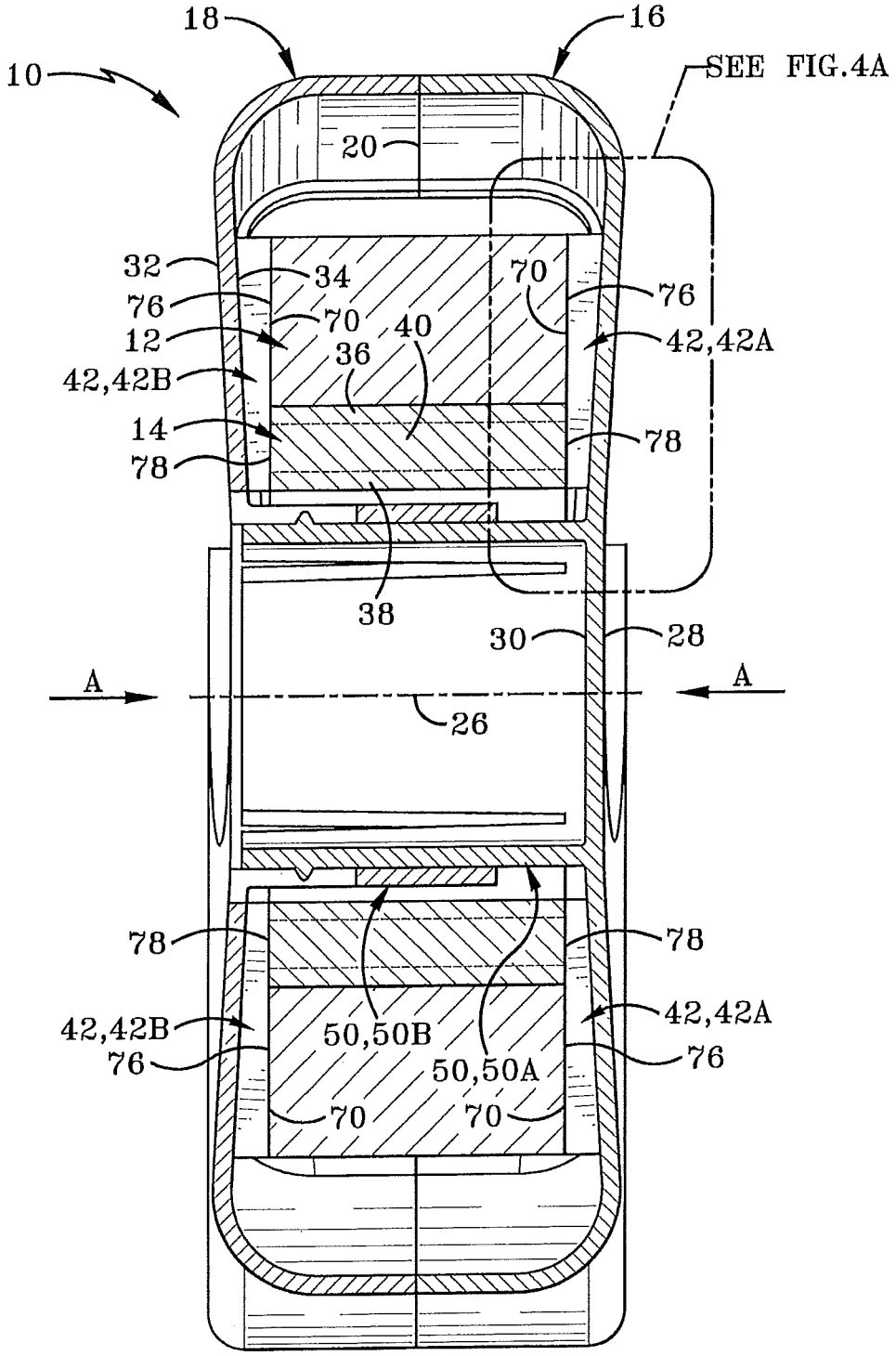
FIG. 4 is an operational cross section view of the tape dispenser in FIG. 3.
Figure 4A:
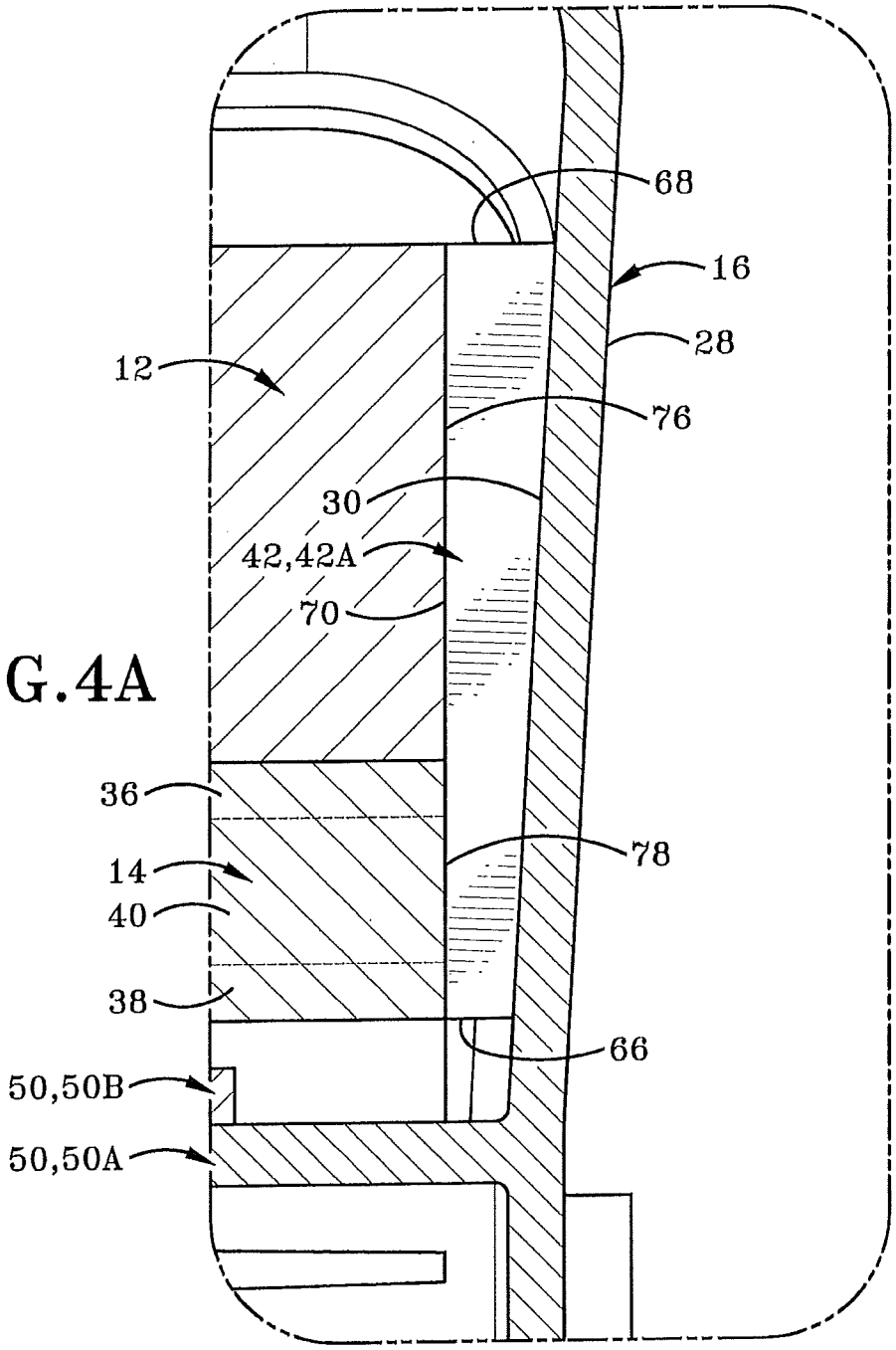
FIG. 4A is an enlarged operational cross section view of the region labeled "SEE FIG. 4A" in FIG. 4.

In operation and with reference to FIG. 4 and FIG. 4A, the tape dispenser 10 enables the braking and slowing of adhesive tape 12 from being dispensed. The first and second side members 16, 18 are generally formed from a flexible material such as plastic enabling them to slightly bend and flex inwardly when center portions are depressed along the transverse axis 26 in the direction of Arrow A indicated in FIG. 4. The inward deflection of first and second side members 16, 18 moves their respective inner surfaces closer toward each other. The movement of inner surface 30 towards inner surface 34 causes the brake spokes 42 to move therewith.

Tape dispenser 10 encourages an operator to depress the first side member 16 and the second side member 18 at its center along axis 26. Accordingly, the proximal portions of the first and second side members 16, 18 that are closer to the transverse hub axis 26 deflect more than the distal portions of the same wall of a respective side member. Because the proximal portions of the side member wall deflect more than the distal portions, the tapered terminal end wall 70 of the brake spoke 42 contacts annular side wall 76 defined by the wound adhesive tape 12 and the hub side wall 78 simultaneously as indicated in FIG. 4A. When the side members 16, 18 are flexed into their braking position (FIG. 4A), the tapered terminal end wall 70 provides constant contact with the outer side wall of hub 14 and the outer side wall of adhesive tape 12. The constant contact is primarily established based on the tapered formation of the brake spoke as described above.

In accordance with an aspect of the present disclosure, brake spokes 42 provide advantages over previously known braking mechanisms on tape dispensers because during the manufacture of the tape and hub, there are tolerance variations in the tape and the tape hub. Thus, if the tape hub transverse width is not equal to the tape transverse width (i.e. less than or greater than), then the brake spokes 42 having a tapered terminal end wall 70 will compensate in the event the adhesive tape width is not exactly equal with the transverse hub width. Furthermore, even when the tape leaves a manufacturing facility from Asia bound for the United States, it is typically shipped via shipping container. The long container shipping transport of tape rolls are often in hot conditions which make it possible for the rolled adhesive tape to be conically displaced in even small increments. The tape dispenser 10 having a taper end wall 70 on brake 42 overcomes deformities in the roll of adhesive tape and still enables the tape dispenser 10 to brake the unwinding of adhesive tape 12 unwinding from hub 14.

The radial length of brake spoke 42A and brake spoke 42B is identified by radially aligned linear dimension 80 which is equal to the tape adhesive roll less radius R1 of the inner cylindrical member of hub 14. Dimension 80 may be in a range of about one-half inch to about one inch. Linear dimension 80 is the length of the radially aligned annular sidewall defined by the wound adhesive tape when the tape is new and unused.

Figure 5:
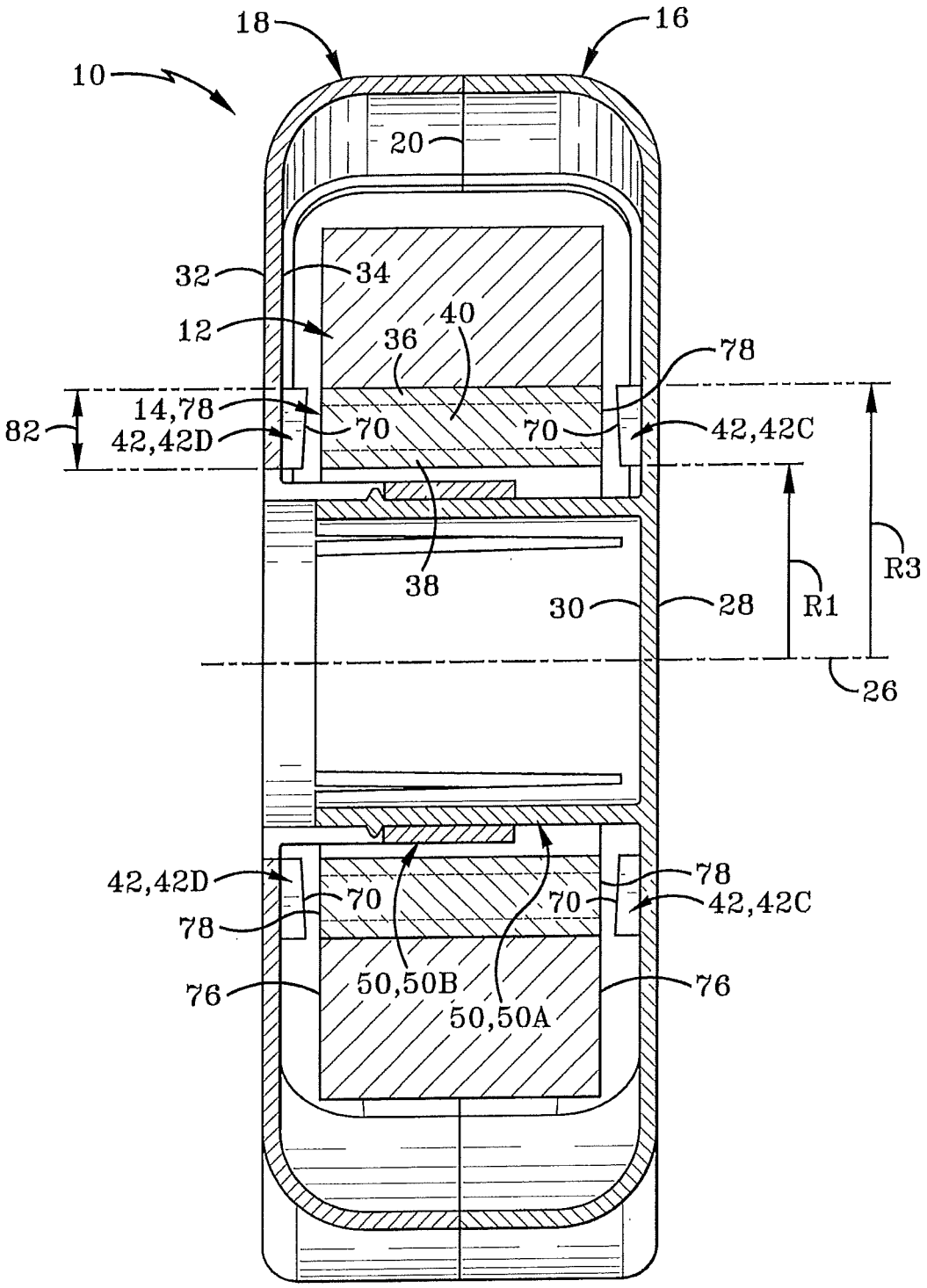
FIG. 5 is a transverse cross section view taken along line 3-3 in FIG. 1 of the assembled tape dispenser having the type of brake spokes presented in FIG. 2B.

As depicted in the transverse cross-section of FIG. 5, the plurality of brake spokes 42C and 42D associated with the tape dispenser 10 depicted in FIG. 2B are identified as having a tapering terminal end wall extending from a distal end to a proximal end. Terminal end wall of brake spokes 42C, 42D extends a shorter dimension 82 which is equal to that of radius R3 less radius R2. Dimension 82 may be in a range from about one-eighth inch to about one-half inch.

While the brake spokes identified in FIG. 5 only contact brake hub 14 to effectuate the cessation of dispensing adhesive tape 12 from tape dispenser 10, the tapered wall principle described above still applies. Namely, when the first and second side members 16, 18 are flexed inwardly towards each other along transverse axis 26, proximal ends of brake spokes 42C, 42D deflect a greater distance than the distal ends of the respective brake spokes. As such, a uniform constant contact is applied across the tapering terminal end wall with the side wall 78 of hub 14.

Figure 6:
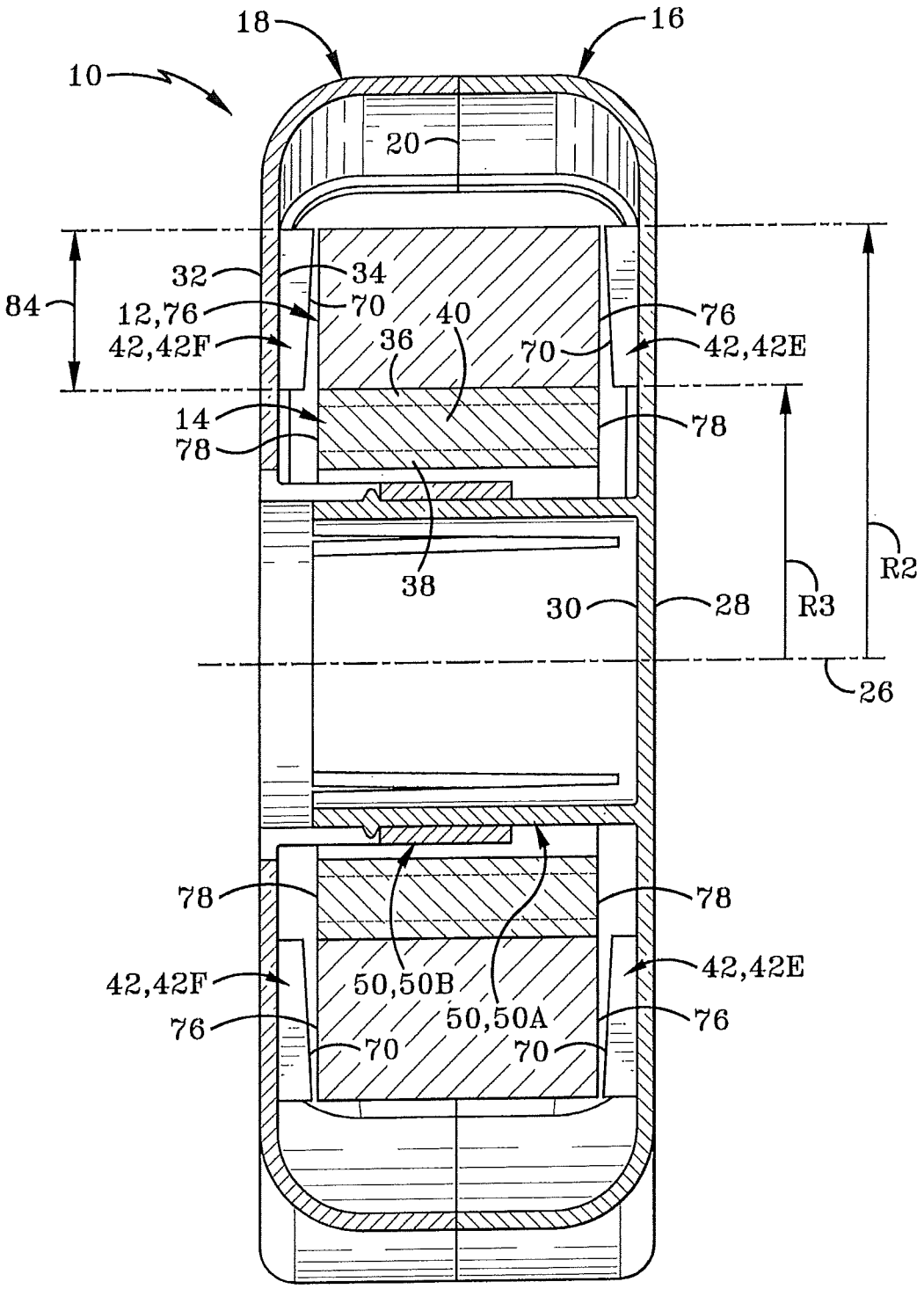
FIG. 6 is a transverse cross section view taken along line 3-3 in FIG. 1 of the assembled tape dispenser having the type of brake spokes presented in FIG. 2C.

As depicted in the transverse cross-section of FIG. 6, the brake spokes 42E and 42F are shown as extending inwardly from the first side member 16 and the second side member 18, respectively. Brake spokes 42E, 42F are positioned in a manner such that they effectuate a braking force to the adhesive tape 12 during squeezing application of force as described above. The radially aligned linear length dimension 84 of brake spokes 42E, 42F is defined by radius R1 less radius R3. The dimension 84 is in a range from about one-fourth inch to about three-fourths inch. Similar to the other embodiments, brake spokes 42E, 42F include a terminal wall that tapers from a distal end towards the proximal end. Thus, the squeezing application of force of the two side members inwardly towards each other creates a constant contact of the terminal end wall 70 with the side wall 76 defined by the wall of adhesive tape 12.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the preferred embodiment of the disclosure are an example and the disclosure is not limited to the exact details shown or described.

What is claimed:

1. A tape dispenser comprising:

a first side member and an opposing second side member;

an axle extending between the first and second side members defining a hub axis;

a hub carrying wound adhesive tape therearound configured to be unwound and dispensed, and the hub positioned concentric around the axle to rotate about the hub axis;

a first brake spoke extending from a first inner surface on the first side member and a free end wall on the first brake spoke, wherein when the first side member is flexed, and the end wall effectuates braking of the adhesive tape and the hub by contacting one of the following (i) the adhesive tape, (ii) the hub, and (iii) the adhesive tape and the hub simultaneously;

an imaginary radial line extending radially from the hub axis, wherein the imaginary radial line intersects the first brake spoke at two points;

wherein the imaginary radial line intersects the brake spoke at first and second ends;

wherein the imaginary radial line does not intersect an intermediate portion of the brake spoke.

2. The tape dispense of claim 1, further comprising:

an apex of the brake spoke, wherein the imaginary radial line does not intersect the apex of the brake spoke.

3. A tape dispenser comprising:

a first side member and an opposing second side member;

an axle extending between the first and second side members defining a hub axis;

a hub carrying wound adhesive tape therearound configured to be unwound and dispensed, and the hub positioned concentric around the axle to rotate about the hub axis;

a first brake spoke extending from a first inner surface on the first side member and a free end wall on the first brake spoke, wherein when the first side member is flexed, and the end wall effectuates braking of the adhesive tape and the hub by contacting one of the following (i) the adhesive tape, (ii) the hub, and (iii) the adhesive tape and the hub simultaneously;

an imaginary radial line extending radially from the hub axis, wherein the imaginary radial line intersects the first brake spoke at two points; and a plurality of brake spokes, wherein the first brake spoke is one brake spoke forming the plurality of brake spokes, wherein the imaginary radial line only intersects the first brake spoke.

4. The tape dispenser of claim 3, wherein the first brake spoke has an arcuate profile.

5. A tape dispenser comprising:

a first side member and an opposing second side member;

an axle extending between the first and second side members defining a hub axis;

a hub carrying wound adhesive tape therearound configured to be unwound and dispensed, and the hub positioned concentric around the axle to rotate about the hub axis;

a first brake spoke extending from a first inner surface on the first side member and a free end wall on the first brake spoke, wherein when the first side member is flexed, and the end wall effectuates braking of the adhesive tape and the hub by contacting one of the following (i) the adhesive tape, (ii) the hub, and (iii) the adhesive tape and the hub simultaneously;

an imaginary radial line extending radially from the hub axis, wherein the imaginary radial line intersects the first brake spoke at two points;

a second brake spoke adjacent the first brake spoke, wherein the imaginary radial line intersects the second brake spoke at least once; and wherein the imaginary radial line intersects the second brake spoke twice.

6. A tape dispenser comprising:

a first side member and an opposing second side member;

an axle extending between the first and second side members defining a hub axis;

a hub carrying wound adhesive tape therearound configured to be unwound and dispensed, and the hub positioned concentric around the axle to rotate about the hub axis;

a first brake spoke extending from a first inner surface on the first side member and a free end wall on the first brake spoke, wherein when the first side member is flexed and the end wall effectuates braking of the adhesive tape and the hub by contacting one of the following (i) the adhesive tape, (ii) the hub, and (iii) the adhesive tape and the hub simultaneously;

an imaginary radial line extending radially from the hub axis, wherein the imaginary radial line intersects the first brake spoke at two points a first set of brake spokes extending in a cantilevered manner from an inner surface on first side member;

a second set of brake spokes extending in a cantilevered manner from an inner surface on the second side member; and wherein brake spokes in the first set and in the second set are non-linear when viewed from the side.

7. The tape dispenser of claim 6, wherein each brake spoke in the first set and in the second set are arcuate.

8. The tape dispenser of claim 6, wherein brake spokes in the first set and in the second set comprise a first end, a second end, and an intermediate portion.

9. The tape dispense of claim 8, wherein the imaginary radial line intersects the first end and the second end on one brake spoke from either the first set or the second set and does not intersect the intermediate portion.

10. The tape dispenser of claim 9, further comprising:

an offset distance of the intermediate portion relative to the imaginary radial line.

11. A tape dispenser comprising:

a first side member and an opposing second side member;

an axle extending between the first and second side members defining a hub axis;

a hub carrying wound adhesive tape therearound configured to be unwound and dispensed, and the hub positioned concentric around the axle to rotate about the hub axis;

a first brake spoke extending from a first inner surface on the first side member and a free end wall on the first brake spoke, wherein when the first side member is flexed, and the end wall effectuates braking of the adhesive tape and the hub by contacting one of the following (i) the adhesive tape, (ii) the hub, and (iii) the adhesive tape and the hub simultaneously;

an imaginary radial line extending radially from the hub axis, wherein the imaginary radial line intersects the first brake spoke at two points a first set of brake spokes extending in a cantilevered manner from an inner surface on first side member;

a second set of brake spokes extending in a cantilevered manner from an inner surface on the second side member;

a first length of one brake spoke in the first set;

a second length of one brake spoke in the second set;

wherein the first and second lengths correspond to a distance that contacts the adhesive tape and hub simultaneously during a braking action.

12. The tape dispenser of claim 11, further comprising a first width and a second width associated with the first brake spoke, wherein the first width is greater than the second width.

13. The tape dispenser of claim 12, wherein the first width is radially distal from the second width relative to the hub axis.

* * * * *